US009157176B2

(12) United States Patent
Lee et al.

(10) Patent No.: US 9,157,176 B2
(45) Date of Patent: Oct. 13, 2015

(54) WASHING MACHINE

(75) Inventors: Kyubum Lee, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 928 days.

(21) Appl. No.: 13/306,123

(22) Filed: Nov. 29, 2011

(65) Prior Publication Data

US 2012/0137738 A1 Jun. 7, 2012

(30) Foreign Application Priority Data

Dec. 2, 2010 (KR) ..... 10-2010-0122307
Dec. 2, 2010 (KR) ..... 10-2010-0122310

(51) Int. Cl.
*D06F 37/40* (2006.01)
*D06F 23/04* (2006.01)
*D06F 21/08* (2006.01)

(52) U.S. Cl.
CPC ..... *D06F 21/08* (2013.01); *D06F 23/04* (2013.01); *D06F 37/40* (2013.01)

(58) Field of Classification Search
CPC ..... D06F 37/40; D06F 21/08; D06F 23/04
USPC ..... 68/12.02, 12.24, 23.7, 133
See application file for complete search history.

(56) References Cited

U.S. PATENT DOCUMENTS

| | | | | |
|---|---|---|---|---|
| 6,049,930 | A | 4/2000 | Hisano et al. | |
| 6,332,343 | B1 * | 12/2001 | Koketsu et al. | 68/23.7 |
| 8,782,837 | B2 * | 7/2014 | Lee et al. | 8/159 |
| 2005/0081573 | A1 | 4/2005 | Han | |
| 2009/0242367 | A1 | 10/2009 | Bruel et al. | |

FOREIGN PATENT DOCUMENTS

| | | | |
|---|---|---|---|
| CN | 1269437 | A | 10/2000 |
| JP | 2000-271387 | A | 10/2000 |
| JP | 2008-079884 | A | 4/2008 |
| KR | 10-0378655 | B1 | 3/2003 |
| KR | 10-2003-0078599 | A | 10/2003 |
| KR | 10-2005-0037692 | A | 4/2005 |

* cited by examiner

*Primary Examiner* — Joseph L Perrin
(74) *Attorney, Agent, or Firm* — Dentons US LLP

(57) ABSTRACT

A washing machine capable of preventing damages of a clutch, a motor, etc., by sensing whether the clutch is normally operated. The clutch transmits a rotational force of the rotor to a dehydration shaft. The washing machine includes a washing shaft configured to rotate a pulsator, a dehydration shaft configured to rotate a drum disposed in a reservoir, a rotor coupled with the washing shaft and configured to transmit a rotational force to the washing shaft, a clutch configured to selectively transmit a rotational force of the rotor to the dehydration shaft a shielding member mounted to the clutch, a magnet provided at the rotor, and a magnetic sensor disposed to face the magnet. The magnetic sensor senses a position of the clutch as the shielding member shields a space between the magnet and the magnetic sensor by a motion of the clutch.

11 Claims, 12 Drawing Sheets

WASHING MACHINE

CROSS-REFERENCE TO RELATED APPLICATION

This application claims the benefit of Korean Patent Application No. 10-2010-0122307, filed on Dec. 2, 2010, and Korean Patent Application No. 10-2010-0122310, filed on Dec. 2, 2010, each of which is hereby incorporated by reference for all purposes as if fully set forth herein.

BACKGROUND OF THE DISCLOSURE

1. Field of the Disclosure

The present disclosure relates to a washing machine, and particularly to a washing machine capable of preventing damage to at least one of a clutch, a motor, etc. by sensing whether the clutch, which transmits a rotational force of a is rotor to a dehydration shaft, is normally operated.

2. Background of the Disclosure

Generally, a washing machine is an apparatus to perform a washing process on laundry. The washing process includes accelerating a chemical operation of a detergent by forcibly forming a stream of washing water inside a drum using a mechanical force, and enhancing a washing effect by applying a physical force such as friction or impact to the laundry.

In this washing machine, a stream of washing water is formed by rotating a pulsator installed below the drum in forward and backward directions. Therefore, the washing machine requires a dehydration shaft for rotating the drum, and a washing shaft for driving the pulsator. The washing machine is provided with a clutch for selectively driving the two driving shafts (the washing shaft and the dehydration shaft). The clutch transmits a rotational force generated from a driving motor to the pulsator at the time of a washing process, and selectively transmits the rotational force to the pulsator and the drum at the time of a dehydrating process.

FIG. 1 is a schematic view showing a configuration of a washing machine in accordance with the conventional art.

Referring to FIG. 1, the washing machine 10 is provided with a body 8 which forms the appearance, and the body 8 is provided with a reservoir 1 therein. A drum 2 rotated by a driving motor 7 is provided in the reservoir 1. A pulsator 3 for a washing process is provided below the drum, and is rotatable by the driving motor 7.

The driving motor 7 configured to form a rotational force for rotating the drum 2 and the pulsator 3 is provided below the reservoir 1. The drum 2 receives a rotational force of the driving motor 7 by a dehydration shaft 5, and the pulsator 3 receives the rotational force of the driving motor 7 by a washing shaft 6. The washing shaft 6 and the dehydration shaft 5 are concentrically installed, and the washing shaft 6 is disposed in the dehydration shaft 5. The dehydration shaft 5 and the washing shaft 6 are rotatably supported by a bearing housing 4.

The driving motor 7 includes a stator and a rotor. The stator is provided with a coil and a magnet, and the rotor which covers an outer circumferential surface of the stator is selectively coupled with the washing shaft 6 or the dehydration shaft 5. The rotor rotates by an electromagnetic reciprocal operation with the stator, and transmits a rotational force to the washing shaft 6 and the dehydration shaft 5.

The rotor of the driving motor 7 is selectively coupled with the dehydration shaft 5 or the washing shaft 6 by a clutch. The clutch is moveable up and down by being engaged with the washing shaft 6, and is provided with teeth to be engaged with the rotor. In an up position, the clutch releases a coupled state between the washing shaft 6 and the rotor. In a down position, the clutch couples the washing shaft 6 to the rotor by being engaged with the rotor, thereby transmitting a rotational force of the rotor to the washing shaft 6. Up-down motions of the clutch are performed by an additional clutch motor.

An engaged state between the clutch and the rotor, and an operation of the clutch have to be precisely performed. If a rotational force of the rotor is transmitted to the washing shaft in a state that the clutch has not been completely engaged with the rotor, the teeth of the clutch may be damaged. Furthermore, if the rotor rotates in a state that a coupled state between the clutch and the rotor has not been completely released, the clutch motor or the washing shaft and the dehydration shaft may be damaged due to an impact applied thereto. This may cause operational failures and/or damage to the washing machine.

SUMMARY OF THE DISCLOSURE

Therefore, it is one advantage of the present disclosure to provide a washing machine capable of preventing damage to its components by precisely sensing a position of a clutch and thus precisely sense a coupled state or a released state between the clutch and a rotor, and a washing machine capable of preventing operational failures thereof.

To achieve these and other advantages and in accordance with the purpose of this specification, as embodied and broadly described herein, there is provided a washing machine according to a first embodiment, comprising: a washing shaft; a dehydration shaft; a rotor, coupled to the washing shaft, to transmit a rotational force to the washing shaft; a clutch to selectively couple with the rotor, wherein said coupling is to transmit the rotational force of the rotor to the dehydration shaft; a shielding member mounted to the clutch; a magnet provided at the rotor; and a magnetic sensor disposed to face the magnet, wherein the magnetic sensor sense a change in magnetic field from the magnet caused by the shielding member shielding a space between the magnet and the magnetic sensor by a motion of the clutch, the change in magnetic field indicating a position of the clutch.

In at least one embodiment the magnet has a ring shape, and is concentrically coupled with the rotor. In at least one embodiment the shielding member has a cylindrical shape, and is concentrically coupled with the clutch. In at least one embodiment, an inner diameter of the shielding member is larger than an outer diameter of the magnet, such that the shielding member may encompass an outer circumferential surface of the magnet by a motion of the clutch.

In at least one embodiment the shielding member is configured to shield a space between the magnet and the magnetic sensor facing each other by moving into the space by a motion of the clutch.

In at least one embodiment the magnetic sensor is disposed to face the magnet by being outward spaced from an outer circumferential surface of the magnet by a predetermined gap.

In at least one embodiment the shielding member is formed of a steel-based metallic material.

According to a second embodiment of the invention, there is provided a washing machine, comprising: a washing shaft; a dehydration shaft; a rotor, coupled with the washing shaft, to transmit a rotational force to the washing shaft; a clutch to selectively couple with the rotor, wherein said coupling is configured to transmit the rotational force of the rotor to the dehydration shaft; a shielding member mounted to the clutch; and a magnetism sensing apparatus including a metallic connection member having two ends bent in the same direction, and including a magnet and a magnetic sensor attached to opposite ends of the two ends of the metallic connection member with a predetermined distance therebetween, wherein the magnetic sensor senses a change in the magnetic field from the magnet caused by the shielding member shielding a space between the magnet and the magnetic sensor by a motion of the clutch, the change in magnetic field indicating a position of the clutch.

In at least one embodiment the magnetism sensing apparatus is disposed below the clutch, two ends of the connection member are positioned towards the clutch, and the shielding member is concentrically coupled with the clutch in a cylindrical shape. In at least one embodiment, when the clutch moves downward to be coupled with the rotor, an outer circumferential surface of the shielding member moves into a space between the magnet and the magnetic sensor.

According to a third embodiment of the invention, the magnetism sensing apparatus of the second embodiment is disposed above the clutch, two ends of the connection member are positioned towards the clutch, and the shielding member is concentrically coupled with the clutch in a cylindrical shape. When the clutch is in an up position for releasing a coupled state with the rotor, an outer circumferential surface of the shielding member moves into a space between the magnet and the magnetic sensor.

In at least one embodiment the washing machine further comprises a clutch stopper, disposed above the clutch, to prevent motions of the clutch which has moved upward. In at least one embodiment the magnetism sensing apparatus is coupled with a side surface of the clutch stopper, and senses a coupled state between the clutch and the clutch stopper.

In at least one embodiment the shielding member includes a connection surface connected to an outer circumferential surface of the shielding member and forming an accommodation space. As one end of the magnetism sensing apparatus is accommodated in the accommodation space with a gap, the outer circumferential surface shields a space between the magnet and the magnetic sensor.

According to a fourth embodiment of the invention, there is provided a washing machine, comprising: a washing shaft; a dehydration shaft; a rotor, coupled with the washing shaft, to transmit a rotational force to the washing shaft; a clutch to transmit the rotational force of the rotor to the dehydration shaft by coupling to the rotor, wherein the clutch comprises two states, a released state when the clutch is in an up position, and a coupled state when the clutch is in a down position; a shielding member mounted to the clutch; and a magnetism sensing apparatus having a first magnetic sensor and a first magnet facing each other and configured to sense the clutch in the up position, and having a second magnetic sensor and a second magnet facing each other and configured to sense the clutch in the down position, wherein the shielding member alternately shields a space between the first magnet and the first magnetic sensor, and a space between the second magnet and the second magnetic sensor according to the position of the clutch, and the magnetism sensing apparatus senses a position of the clutch.

In at least one embodiment the shielding member is concentrically coupled with the clutch in a cylindrical shape.

In at least one embodiment the first magnet and the first magnetic sensor are disposed to face each other with a gap therebetween, and the second magnet and the second magnetic sensor are disposed to face each other with a gap therebetween. In at least one embodiment the shielding member is configured to alternately shield a space between the first magnet and the first magnetic sensor, and a space between the second magnet and the second magnetic sensor, by alternately entering the spaces.

In at least one embodiment the shielding member includes an outer circumferential surface, and a connection surface connected to the outer circumferential surface and forms an accommodation space. In at least one embodiment, as the first magnetic sensor or the first magnet of the magnetism sensing apparatus is accommodated in the accommodation space when the clutch is in the up position, the outer circumferential surface of the shielding member shields a space between the first magnet and the first magnetic sensor.

In at least one embodiment the first magnet and the first magnetic sensor are integrally coupled with each other, and the second magnet, and the second magnetic sensor are integrally coupled with each other.

In at least one embodiment the magnetism sensing apparatus is positioned on a side surface of the clutch.

In at least one embodiment the washing machine further comprises a clutch stopper, disposed above the clutch, to prevent motions of the clutch which has moved upward. In at least one embodiment the magnetism sensing apparatus is configured to sense a coupled state between the clutch and the clutch stopper when the clutch is in an up position, and configured to sense a coupled state between the clutch and the rotor when the clutch is in a down position.

In at least one embodiment the shielding member is formed of a steel-based metallic material.

According to a fifth embodiment of the invention, there is provided a washing machine, comprising: a washing shaft; a dehydration shaft; a rotor, coupled with the washing shaft, to transmit a rotational force to the washing shaft; a clutch to selectively couple with the rotor, wherein said coupling is configured to transmit the rotational force of the rotor to the dehydration shaft; a metallic plate of a ring shape mounted to the clutch; and a magnetism sensing apparatus including a metallic connection member having two ends bent in the same direction, and including a magnet and a magnetic sensor attached to opposite ends of the two ends of the metallic connection member with a predetermined distance therebetween, wherein the magnetic sensor senses a position of the clutch by sensing a magnetism increase between the two ends of the metallic connection member as the metallic plate approaches to the magnetism sensing apparatus by a motion of the clutch.

In at least one embodiment the magnetism sensing apparatus is disposed below the clutch so as to sense a down position of the clutch where the clutch and the rotor are coupled with each other.

According to a sixth embodiment of this specification, the magnetism sensing apparatus of the fifth embodiment is disposed above the clutch so as to sense an up position of the clutch where a coupled state between the clutch and the rotor is released. In at least one embodiment the washing machine further comprises a clutch stopper, disposed above the clutch, to prevent motions of the clutch which has moved upward. In at least one embodiment the magnetism sensing apparatus is coupled with a side surface of the clutch stopper, and senses a coupled state between the clutch and the clutch stopper.

Under these configurations, up and/or positions of the clutch may be precisely sensed. This allows a coupled or released state between the clutch and the rotor, and a coupled state between the clutch and the clutch stopper to be precisely sensed.

Furthermore, by sensing a completely coupled or released state between the clutch and the rotor or between the clutch and the clutch stopper, damages or operational failure of a washing machine's components may be prevented. This may enhance the reliability of the washing machine.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a washing machine according to the present disclosure will be explained in more detail with reference to the attached drawings.

The washing machine according to the present disclosure is provided with a reservoir in a body which forms the appearance. A drum rotated by a driving motor is provided in the reservoir. A pulsator for a washing process is provided below the drum, and is rotatable by the driving motor. This configuration is generic, and thus a detailed explanation thereof will be omitted.

Figure 1:
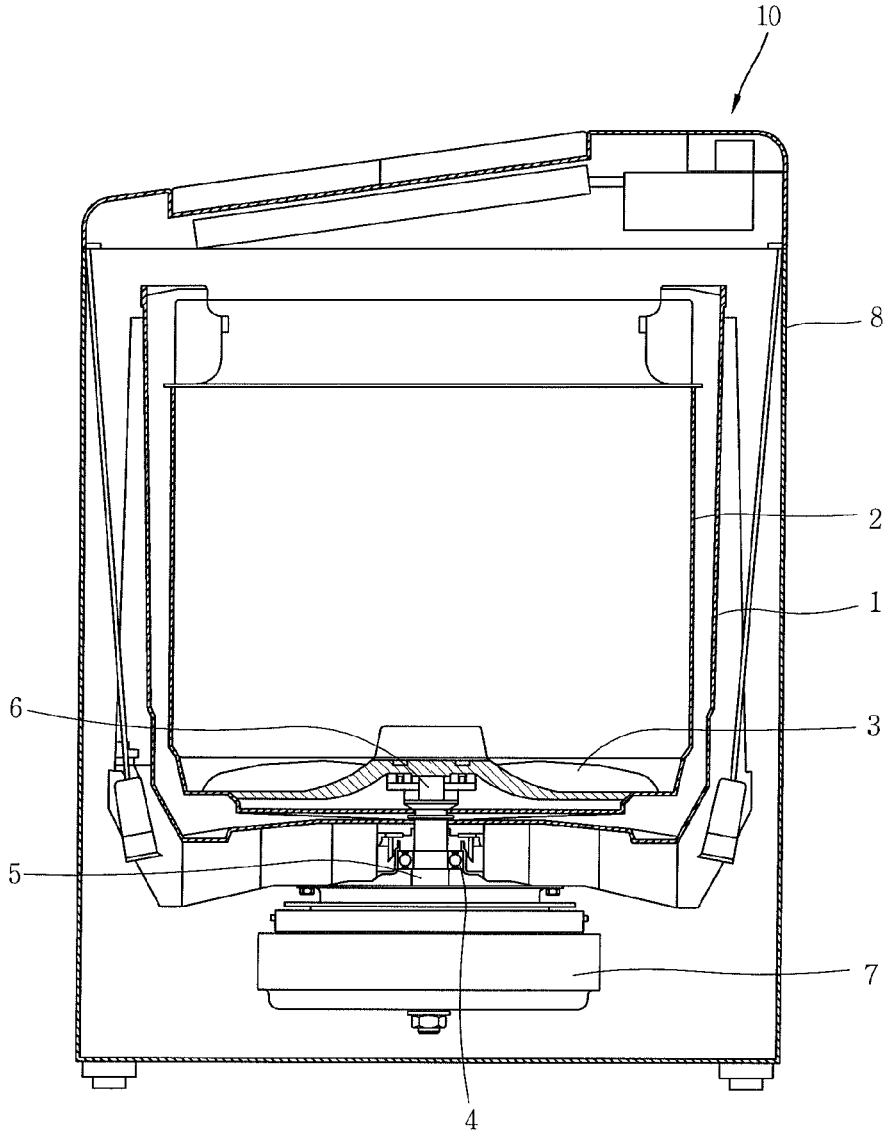
FIG. 1 RELATED ART
FIG. 1 is a schematic view of a washing machine in accordance with the conventional art.
Figure 2:
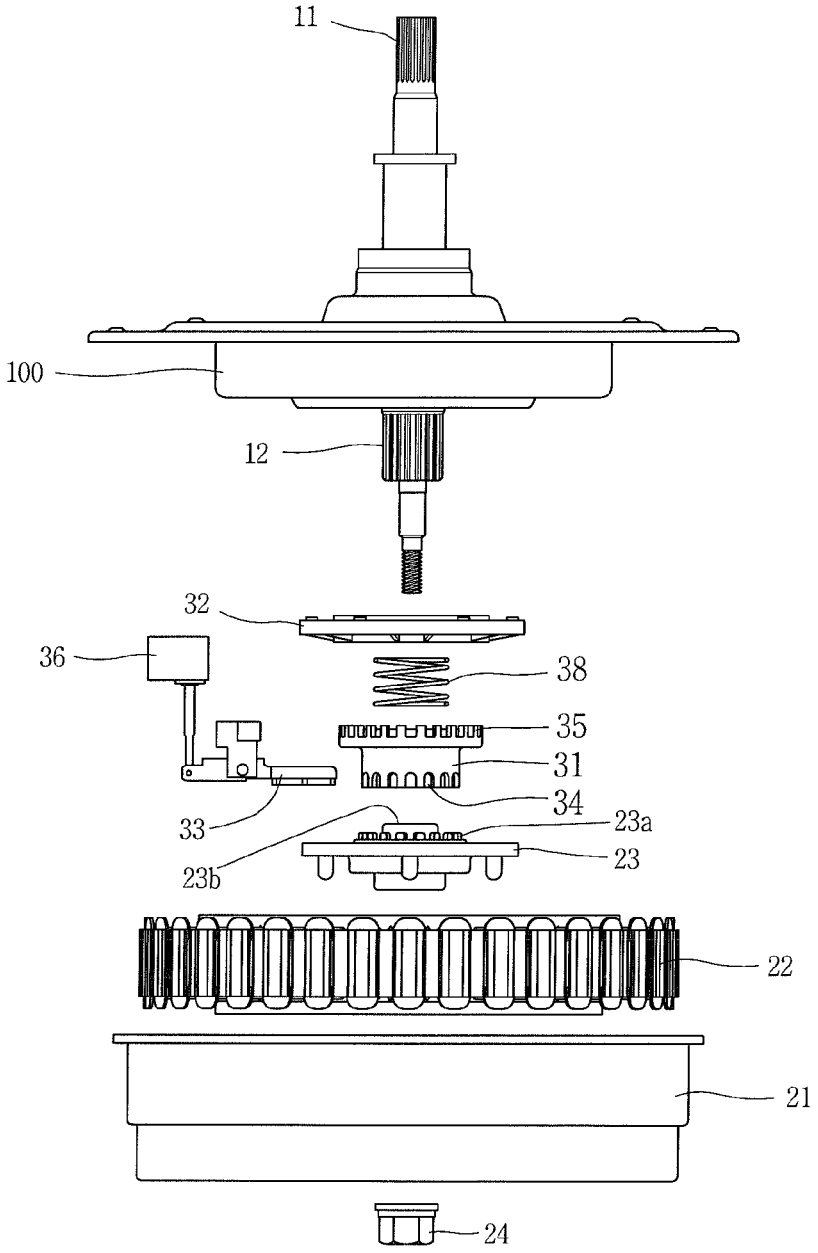
FIG. 2 is an exploded perspective view of a driving unit of a washing machine according to the present disclosure.
Figure 3:
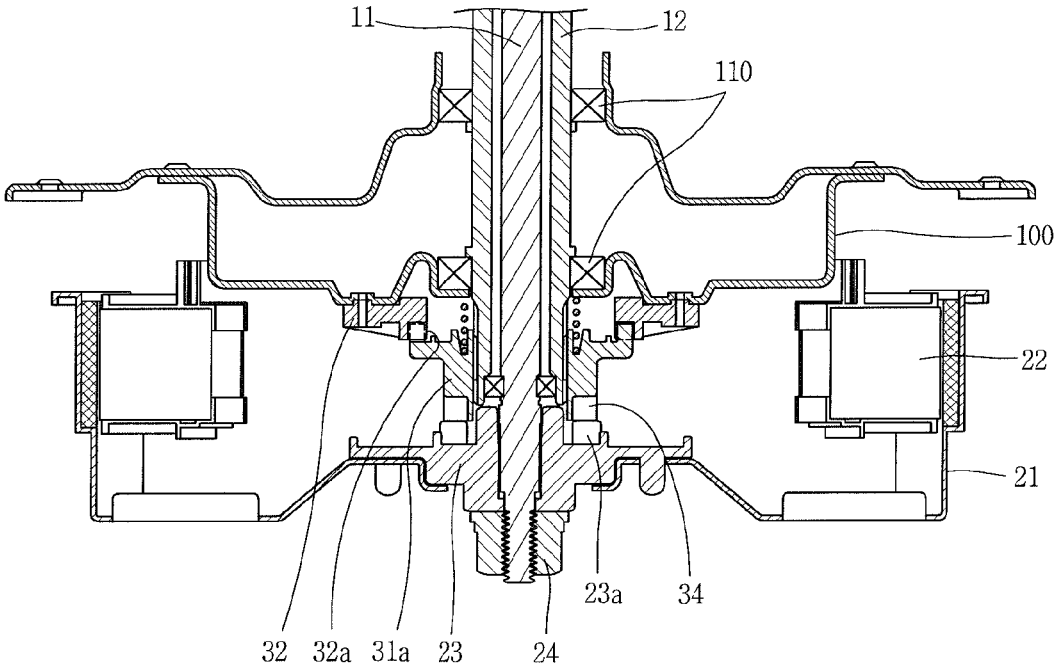
FIG. 3 is an assembled perspective view of the driving unit of a washing machine according to the present disclosure.

FIG. 2 is an exploded perspective view of a driving unit of a washing machine according to the present disclosure, and FIG. 3 is an assembled perspective view of the driving unit of a washing machine according to the present disclosure. FIGS. 2 and 3 do not disclose a defined configuration of a magnetism sensing apparatus or a magnetic sensor for sensing a position of a clutch. The defined configuration has been disclosed in the embodiments to follow. FIGS. 2 and 3 merely disclose a coupling configuration of the magnetism sensing apparatus or the magnetic sensor.

Referring to FIGS. 2 and 3, a driving unit for driving a drum and a pulsator of the washing machine includes a washing shaft 11 configured to rotate a pulsator, a dehydration shaft 12 configured to rotate a drum disposed in a reservoir, a driving motor having a rotor 21 coupled with the washing shaft and transmitting a rotational force to the washing shaft, and a clutch 31 configured to selectively transmit a rotational force of the rotor to the dehydration shaft 12 by being selectively coupled with the rotor by moving up and down.

One end of the washing shaft 11 protrudes to the inside of the drum by penetrating through the center of the dehydration shaft 12, and the pulsator is coupled with the protruding end. Another end of the washing shaft 11 is extends downward to be coupled with the rotor 21 of the driving motor.

The dehydration shaft 12 is provided therein with the washing shaft 11 concentrically installed by penetrating through the dehydration shaft 12. One end of the dehydration shaft 12 is coupled with the drum to transmit a rotational force to the drum, and another end of the dehydration shaft is selectively coupled with the rotor 21 by the clutch 31 to receive a rotational force. The dehydration shaft 12 is provided with teeth (not shown) for engaging with the clutch 31 at an intermediate part thereof. This may allow the clutch 31 to be moveable up and down along the dehydration shaft 12.

The washing shaft 11 and the dehydration shaft 12 are supported at a bearing housing 100, and are rotatable by a bearing 110. The bearing 110, the clutch 31, a clutch driving motor 36, and the driving motor are supported by being coupled with the bearing housing 100.

The driving motor is provided on a bottom surface of the reservoir, and forms a driving force of the drum and the pulsator. The driving motor includes a rotor 21 and a stator 22. The stator 22 is formed in a ring shape, and is provided with a coil wound thereon. The rotor 21 has a vessel shape to cover the stator 22, and is provided with a magnet therein to rotate centering around the stator 22 by a reciprocal operation with the coil wound thereon. The rotor 21 is provided with, at the center thereof, a shaft coupling portion 23 for coupling with the washing shaft 11 and the dehydration shaft 12. The shaft coupling portion 23 includes a shaft through hole **23*b* for penetrating the washing shaft 11 therethrough, and teeth 23*a* to engage with teeth of the clutch 31. The shaft coupling portion 23 and the rotor 21 integrally rotate with each other by being coupled with each other. The washing shaft 11 which penetrates through the shaft coupling portion 23 is fixed to the shaft coupling portion 23 by a nut 24, and rotates integrally with the shaft coupling portion 23**.

The clutch 31 is formed in a cylindrical shape, and has teeth on upper and lower surfaces thereof. The clutch 31 is provided with a through hole at the center thereof so that the washing shaft 11 and the dehydration shaft 12 may penetrate therethrough. Teeth engaged with an outer circumferential surface of the dehydration shaft 12 for sliding thereon are formed on an inner circumferential surface of the through hole. Under this configuration, the clutch 31 is moveable to a down position for coupling with the rotor 21, and an up position for releasing a coupled state with the rotor 21.

The clutch 31 is moveable up and down by a driving means, e.g., a clutch motor 36. A lever 33 is configured to transmit a driving force of the clutch motor 36 to the clutch 31 and is coupled with a side surface of the clutch 31. The clutch 31 moves up and down along the dehydration shaft 12 by receiving a driving force of the clutch motor 36 through the lever 33.

Lower teeth 34 configured to engage with the teeth 23*a* of the shaft coupling portion 23 of the rotor 21 are formed on a lower surface of the clutch 31. A pressurization spring 38 for stably maintaining an engaged state between the clutch 31 and the rotor 21 is provided to press the clutch 31 to the rotor 21.

A clutch stopper 32 fixed to the bearing housing 100 is provided above the clutch 31. The clutch stopper 32 serves to restrict motions of the clutch 31, so as to prevent the occurrence of an impact applied to the clutch motor 36 or the washing shaft 11 and the dehydration shaft 12 due to motions of the clutch 31 after a coupled state between the clutch 31 and the rotor 21 has been released.

The clutch stopper 32 is provided with teeth 32*a* at a lower part thereof. Upper teeth 35 are provided on an upper surface of the clutch 31, and configured to engage with the teeth 32*a* of the clutch stopper 32.

The clutch 31 moves up and down, and selectively transmits a driving force of the driving motor to the dehydration shaft 12. A rotational force of the rotor 21 is selectively transmitted to the dehydration shaft 12 and the washing shaft 11 by the clutch 31.

In the first embodiment, it is sensed whether the clutch 31 has been completely coupled with the rotor 21.

Figure 4:
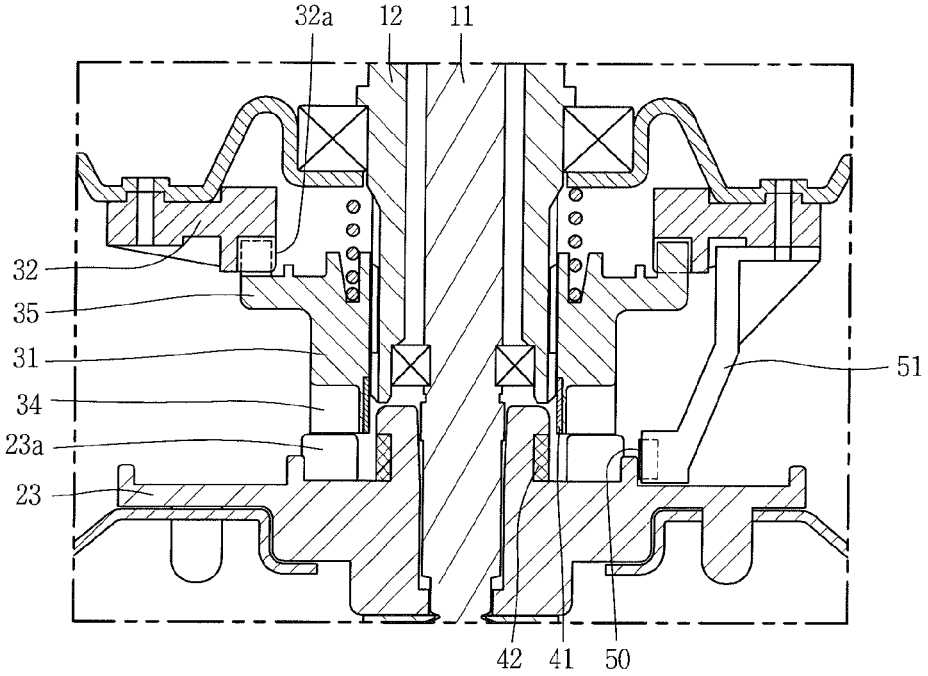
FIGS. 4 and 5 are partial sectional views showing a washing machine according to a first embodiment of the present disclosure.
Figure 5:
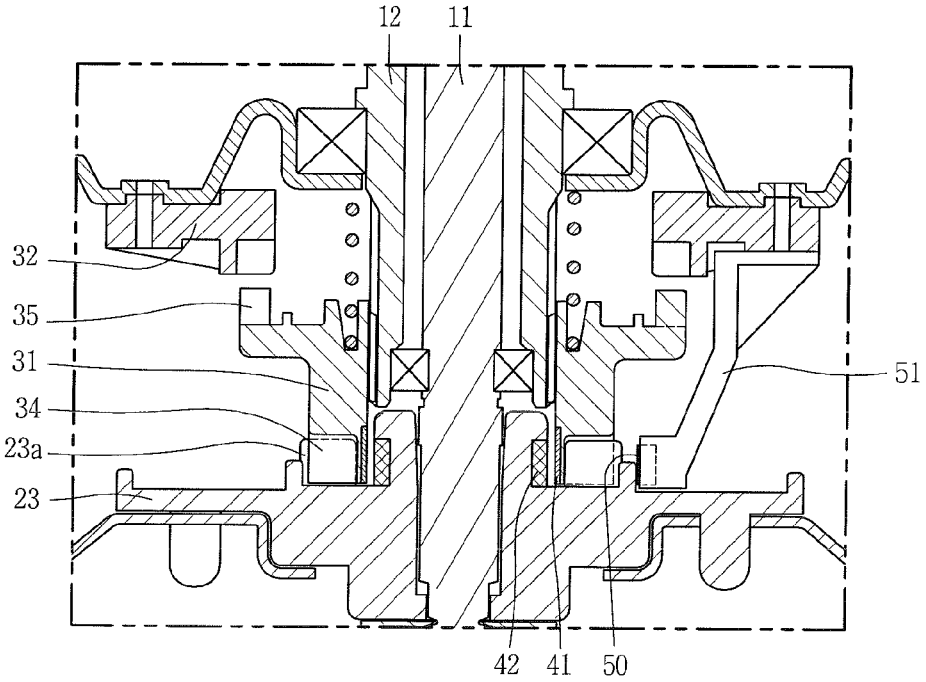

FIGS. 4 and 5 show means for sensing a position of the clutch 31 according to a first embodiment of the present disclosure. Referring to FIGS. 4 and 5, a washing machine according to the first embodiment of the present disclosure comprises a shielding member 41 mounted to the clutch 31, a magnet 42 provided at the rotor, and a sensor 50 facing the magnet 42.

In at least one embodiment the shielding member 41 is coupled with an inner circumferential surface of the lower teeth 34 of the clutch 31. In at least one embodiment the shielding member 41 is inserted into the clutch. As explained later, a coupling position of the shielding member 41 to a lower part of the clutch 31 does not matter so long as the shielding member 41 can shield a space between the magnet 42 and the magnetic sensor 50 when the clutch 21 is in the down position.

The shielding member 41 has to be concentrically coupled with the clutch 31 in a cylindrical shape. Preferably, the shielding member 41 is formed of a steel-based metallic material. However, the shielding member 41 may be formed of a metallic material having a magnetic property, rather than the steel-based metallic material. Once the shielding member 41 is in a position where a magnetic field is formed, the shielding member 41 can perform a shielding function since lines of induction are concentrated thereto.

The magnet 42 is formed in a ring shape, and is coupled with the shaft coupling portion 23 of the rotor 21 in a concentric manner to the rotor 21. More specifically, the magnet 42 is coupled with a surface of the shaft through hole 23*b* of the shaft coupling portion 23.

As shown in FIG. 4, the magnet 42 and the shielding member 41 are concentrically disposed in a cylindrical shape. As shown in FIG. 5, an inner diameter of the shielding member 41 is formed to be larger than an outer diameter of the ring-shaped magnet. Accordingly, when the clutch moves downward, the shielding member 41 encompasses an outer circumferential surface of the magnet 42.

The magnetic sensor 50 is disposed to face the magnet 42 by being outward spaced from an outer circumferential surface of the magnet 42 by a predetermined gap. The magnetic sensor 50 is fixed, and is coupled with a holding plate 51 extending from the bearing housing 100 or the clutch stopper 32.

The magnet 42 and the shielding member 41 are disposed in a cylindrical shape in a concentric manner with the dehydration shaft 12. This may allow a magnetic field to be formed at the periphery or allow a magnetic field to be shielded without an influence from a position of the magnetic sensor 50 even if the clutch 31 rotates by rotation of the rotor 21.

Referring to FIG. 4, in an up position, the clutch 31 is in a fixed state by being engaged with the clutch stopper 32. As a result, the shielding member 41 does not have influence on the magnet 42 and the magnetic sensor 50. Accordingly, the magnet 42 forms a magnetic field at the periphery, and the magnetic sensor 50 facing the magnet 42 senses that the clutch 31 and the rotor 21 have not been engaged with each other by sensing a magnetism.

Referring to FIG. 5, as the shielding member 41 shields a space between the magnet 42 and the magnetic sensor 50 by a motion of the clutch 31, the magnetic sensor 50 senses a position of the clutch 31. Specifically, the shielding member 41 is in a space between the magnet 42 and the magnetic sensor 50 facing each other by a motion of the clutch 31, thereby shielding the space. Generally, if a metallic member having a magnetic property is positioned near a magnet, a magnetic field of the magnet is concentrated (i.e., drawn) to the metallic member.

Therefore, if the shielding member 41 is in a space between the magnet 42 and the magnetic sensor 50, a magnetic field does not trigger the magnetic sensor 50 since lines of induction of the magnet 42 are concentrated to the shielding member 41. That is, the magnetic sensor 50 senses an engaged state between the clutch 31 and the shaft coupling portion 23 of the rotor 21 by a magnetic field which has disappeared therefrom.

In the first embodiment, when the rotor 21 and the clutch 31 have been coupled with each other, a magnetic field sensed by the magnetic sensor 50 may be completely shielded. That is, whether the rotor 21 and the clutch 31 have been coupled with each other may be sensed more precisely by completely shielding a magnetic field rather than by sensing the approach of a magnet. This may allow whether the rotor 21 and the clutch 31 have been coupled with each other to be precisely sensed, and thus may prevent damage and/or operational failure of the driving unit of the washing machine.

In the second embodiment, it is sensed whether the clutch 31 has been completely coupled with the rotor 21.

Figure 6:
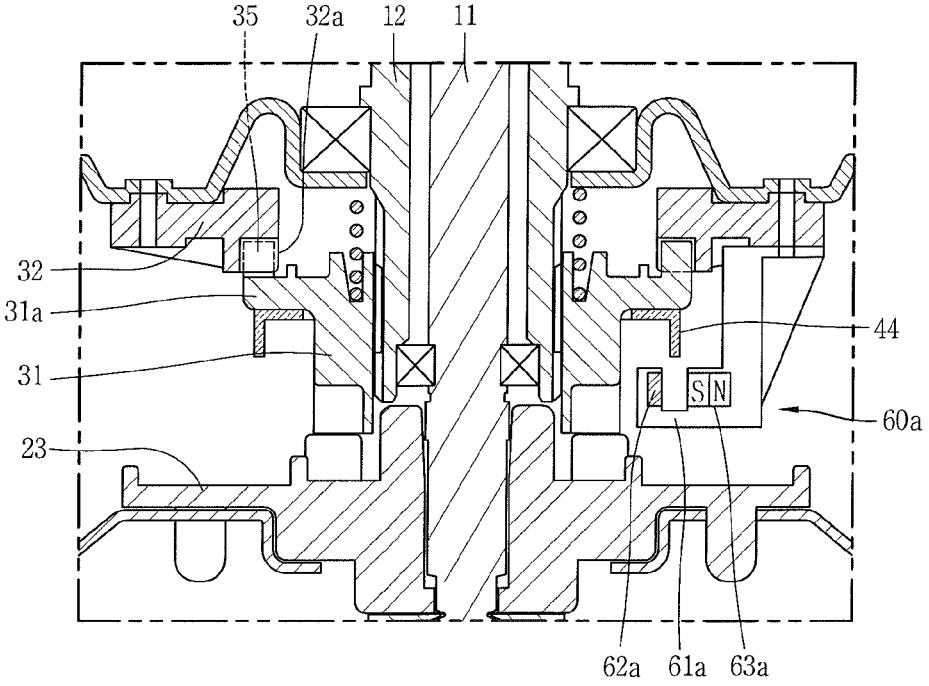
FIG. 6 is a partial sectional view showing a washing machine according to a second embodiment of the present disclosure.

Referring to FIG. 6, a washing machine according to the second embodiment of the present disclosure comprises a shielding member 44 mounted to a clutch 31, and a magnetism sensing apparatus 60*a* including a metallic connection member 61*a* having two ends bent in the same direction with a predetermined distance therebetween, a magnet 63*a* coupled with one end of the metallic connection member 61*a*, and a magnetic sensor 62*a* coupled with another end of the metallic connection member 61*a*.

As shown in FIG. 6, the shielding member 44 is coupled with an upper part of the clutch 31 so that upper teeth 35 may be formed. An extended surface 31*a* of a ring shape which outwardly extends from the center of the clutch 31 is provided at an upper part of the clutch 31. The shielding member 44 is coupled to a lower surface of the extended surface 31*a* in a concentric manner to the clutch 31. This allows the shielding member 44 to always be positioned on the lower surface of the extended surface 31*a* without being influenced from rotation of the clutch 31.

The shielding member 44 is provided with a cylindrical outer circumferential surface, and a ring-shaped coupling surface for coupling with the extended surface 31*a*. As the outer circumferential surface of the shielding member 44 shields a space between the magnet 63*a* and the magnetic sensor 62*a* by a motion of the clutch 31, the magnetic sensor 62*a* senses a position of the clutch 31.

Preferably, the shielding member 44 is formed of a steel-based metallic material. However, the shielding member 44 may be formed of a metallic material having a magnetic property, rather than the steel-based metallic material. Once the shielding member 44 is in a position where a magnetic field is formed, the shielding member 44 can perform a shielding function since lines of induction are concentrated (i.e., drawn) thereto.

Figure 7:
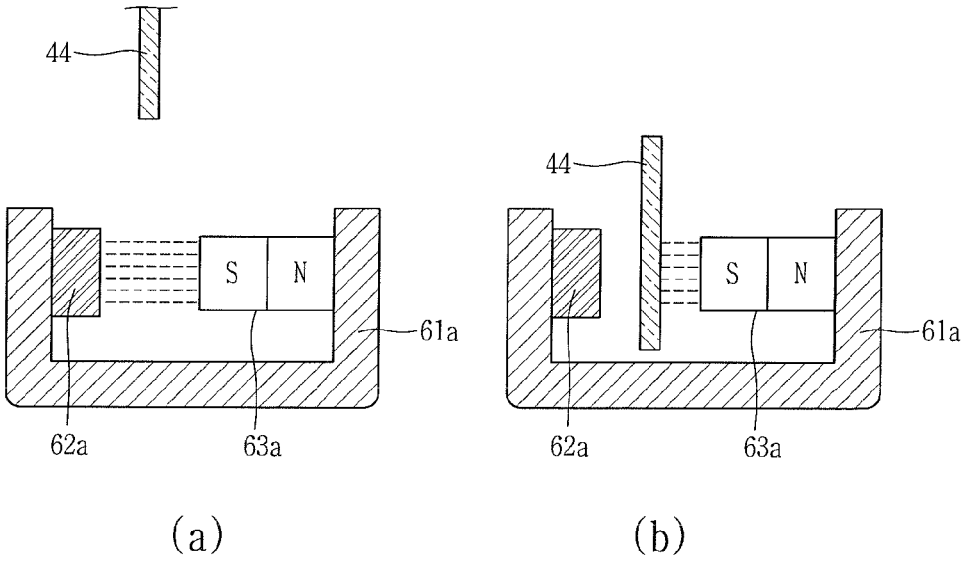
FIG. 7 is a schematic view showing a principle of the second embodiment.

The magnetism sensing apparatus 60*a* includes the metallic connection member 61*a*, the magnetic sensor 62*a*, and the magnet 63*a*. The metallic connection member 61*a* is formed in a '⊂' shape, and is provided with the magnetic sensor 62*a* and the magnet 63*a* on inner side surfaces of two ends thereof as shown in FIG. 7. The two ends of the metallic connection member 61*a* are bent in the same direction. That way, the magnetic sensor 62*a* and the magnet 63*s* can be spaced from each other.

The magnetism sensing apparatus 60*a* is disposed below the clutch 31. As shown in FIG. 6, the magnetism sensing apparatus 60*a* is fixed to a holding plate coupled with the clutch stopper 32. The two ends of the metallic connection member 61*a* are towards the clutch 31. More specifically, the two ends of the metallic connection member 61*a* are toward an upper side where the shielding member 44 has been coupled with the clutch 31. The shielding member 44 has an outer circumferential surface of a cylindrical shape, and is concentrically coupled with the clutch 31. As shown in FIG. 7, when the clutch 31 is in a down position for coupling with the rotor 21, the outer circumferential surface of the shielding member 44 is in a space between the magnet 63*a* and the magnetic sensor 62*a*.

FIG. 7(*a*) shows an up position of the clutch 31. Referring to FIG. 7(*a*), the shielding member 41 is spaced from the magnet 63*a* and the magnetic sensor 62*a*, thereby not shielding a space between the magnet 63*a* and the magnetic sensor 62*a*. FIG. 7(*b*) shows a down position of the clutch 31. Generally, if a metallic member having a magnetic property is positioned near a magnet, a magnetic field of the magnet is concentrated (i.e., drawn) to the metallic member. Therefore, if the outer circumferential surface of the shielding member 44 is in a space between the magnet 63*a* and the magnetic sensor 62*a*, a magnetic field does not trigger the magnetic sensor 62*a* since lines of induction of the magnet 63*a* are concentrated to the shielding member 44. That is, the magnetic sensor 62*a* senses an engaged state between the clutch 31 and the shaft coupling portion 23 of the rotor 21 by a magnetic field which has disappeared therefrom.

In the second embodiment, when the rotor 21 and the clutch 31 have been coupled with each other, a magnetic field sensed by the magnetic sensor 62*a* may be completely shielded. That is, whether the rotor 21 and the clutch 31 have been coupled with each other may be sensed more precisely by completely shielding a magnetic field rather than by sensing the approach of a magnet. This allows whether the rotor 21 and the clutch 31 have been coupled with each other to be precisely sensed, and thus may prevent damage and/or operational failure of the driving unit of the washing machine.

In the third embodiment, it is sensed whether a coupled state between the clutch 31 and the rotor 21 has been completely released. That is, it is sensed whether the clutch 31 is prevented from moving by being completely coupled with the clutch stopper 32.

Figure 8:
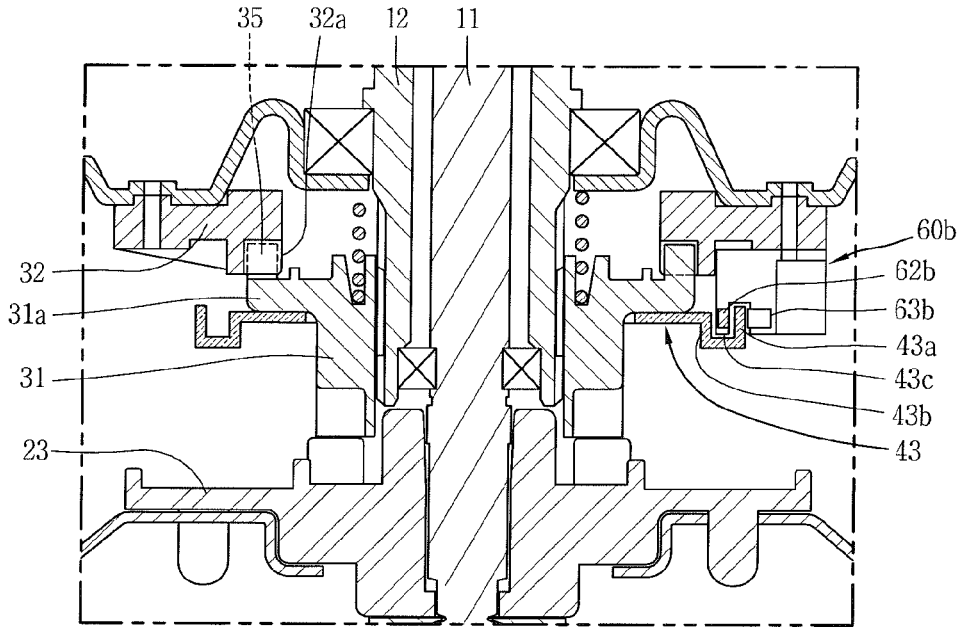
FIG. 8 is a partial sectional view showing a washing machine according to a third embodiment of the present disclosure.

Referring to FIG. 8, a washing machine according to the third embodiment of the present disclosure comprises a shielding member 43 mounted to a clutch 31, and a magnetism sensing apparatus 60*b* including a metallic connection member 61*b* having two ends bent in the same direction with a predetermined distance therebetween, a magnet 63*b* coupled with one end of the metallic connection member 61*b*, and a magnetic sensor 62*b* coupled with another end of the metallic connection member 61*b*.

As shown in FIG. 8, the shielding member 43 is coupled with an upper part of the clutch 31 so that upper teeth 35 may be formed. An extended surface 31*a* of a ring shape which outwardly extends from the center of the clutch 31 is provided at an upper part of the clutch 31. The shielding member 43 is coupled with a lower surface of the extended surface 31*a* in a concentric manner to the clutch 31. This may allow the shielding member 43 to be always positioned on the lower surface of the extended surface without being influenced from rotation of the clutch 31.

The shielding member 43 is provided with a cylindrical outer circumferential surface 43*a*, and ring-shaped coupling surfaces 43*b* and 43*c* extending from the outer circumferential surface 43*a* so as to be coupled with the extended surface 31*a*. The shielding member 43 forms an accommodation space by the coupling surfaces connected to the outer circumferential surface thereof. As one end of the magnetism sensing apparatus 60*b* is accommodated in the accommodation space, the outer circumferential surface of the shielding member 43 shields a space between the magnet 63*b* and the magnetic sensor 62*b*. That is, as the outer circumferential surface 43*a* of the shielding member shields a space between the magnet 63*b* and the magnetic sensor 62*b* by a motion of the clutch 31, the magnetic sensor 62*b* senses a position of the clutch 31.

Preferably, the shielding member 43 is formed of a steel-based metallic material. However, the shielding member 43 may be formed of a metallic material having a magnetic property, rather than the steel-based metallic material. Once the shielding member 43 is in a position where a magnetic field is formed, the shielding member 43 can perform a shielding function since lines of induction are concentrated (i.e., drawn) thereto.

Figure 9:
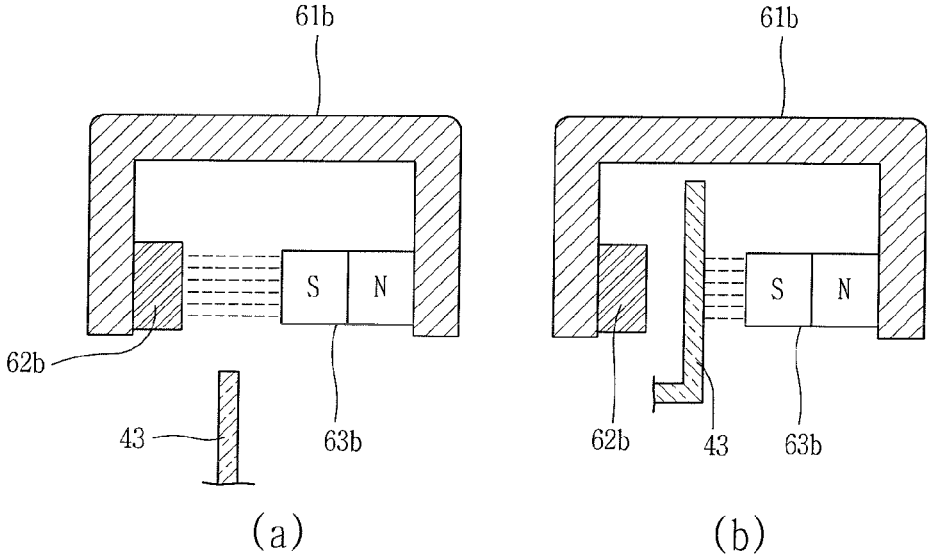
FIG. 9 is a schematic view showing a principle of the third embodiment.

The magnetism sensing apparatus 60*b* includes the metallic connection member 61*b*, the magnetic sensor 62*b*, and the magnet 63*b*. The metallic connection member 61*b* is formed in a '⊂' shape, and is provided with the magnetic sensor 62*b* and the magnet 63*b* on inner side surfaces of two ends thereof as shown in FIG. 9. The two ends of the metallic connection member 61*b* are bent in the same direction. This allows the magnetic sensor 62*b* and the magnet 63*b* to be spaced from each other.

The magnetism sensing apparatus 60*b* is disposed above the clutch 31. As shown in FIG. 8, the magnetism sensing apparatus 60*b* is coupled with a bottom surface of the clutch stopper 32 disposed above the clutch 31. As shown in FIG. 8, the magnetism sensing apparatus 60*b* is fixed to a holding plate coupled with the clutch stopper 32. The two ends of the metallic connection member 61*b* are bent towards a lower side. More specifically, the two ends of the metallic connection member 61*b* are towards a lower side where the outer circumferential surface of the shielding member 43 coupled with the clutch 31 is disposed. The shielding member 43 has an outer circumferential surface of a cylindrical shape, and is concentrically coupled with the clutch 31. As shown in FIG. 8, when the clutch 31 is in an up position for coupling with the clutch stopper 32, the outer circumferential surface of the shielding member 43 is in a space between the magnet 63*b* and the magnetic sensor 62*b*.

When the clutch 31 is in an up position, the magnetism sensing apparatus 60*b* is disposed on a side surface of the clutch stopper 32 to sense a coupled state between the clutch 31 and the clutch stopper 32.

FIG. 9(*a*) shows a down position of the clutch 31. Referring to FIG. 9(*a*), the shielding member 43 is spaced from the magnet 63*b* and the magnetic sensor 62*b*, thereby not shielding a space between the magnet 63*b* and the magnetic sensor 62*b*. FIG. 9(*b*) shows an up position of the clutch 31. Generally, if a metallic member having a magnetic property is positioned near a magnet, a magnetic field of the magnet is concentrated to the metallic member. Therefore, if the outer circumferential surface of the shielding member 43 is in a space between the magnet 63*b* and the magnetic sensor 62*b*, a magnetic field does not trigger the magnetic sensor 62*b* since lines of induction of the magnet 63*b* are concentrated (i.e., drawn) to the shielding member 43. That is, the magnetic sensor 62*b* senses an engaged state between the clutch 31 and the clutch stopper 32 by a magnetic field which has disappeared therefrom.

In the third embodiment, when the clutch 31 and the clutch stopper 32 have been coupled with each other, a magnetic field sensed by the magnetic sensor 62*b* may be completely shielded. That is, whether the rotor 21 and the clutch 31 have been coupled with each other may be sensed more precisely by completely shielding a magnetic field rather than by sensing the approach of a magnet. This allows whether a coupled state between the rotor 21 and the clutch 31 has been released or not to be precisely sensed, and thus may prevent damage and/or operational failure of the driving unit of the washing machine.

Figure 10:
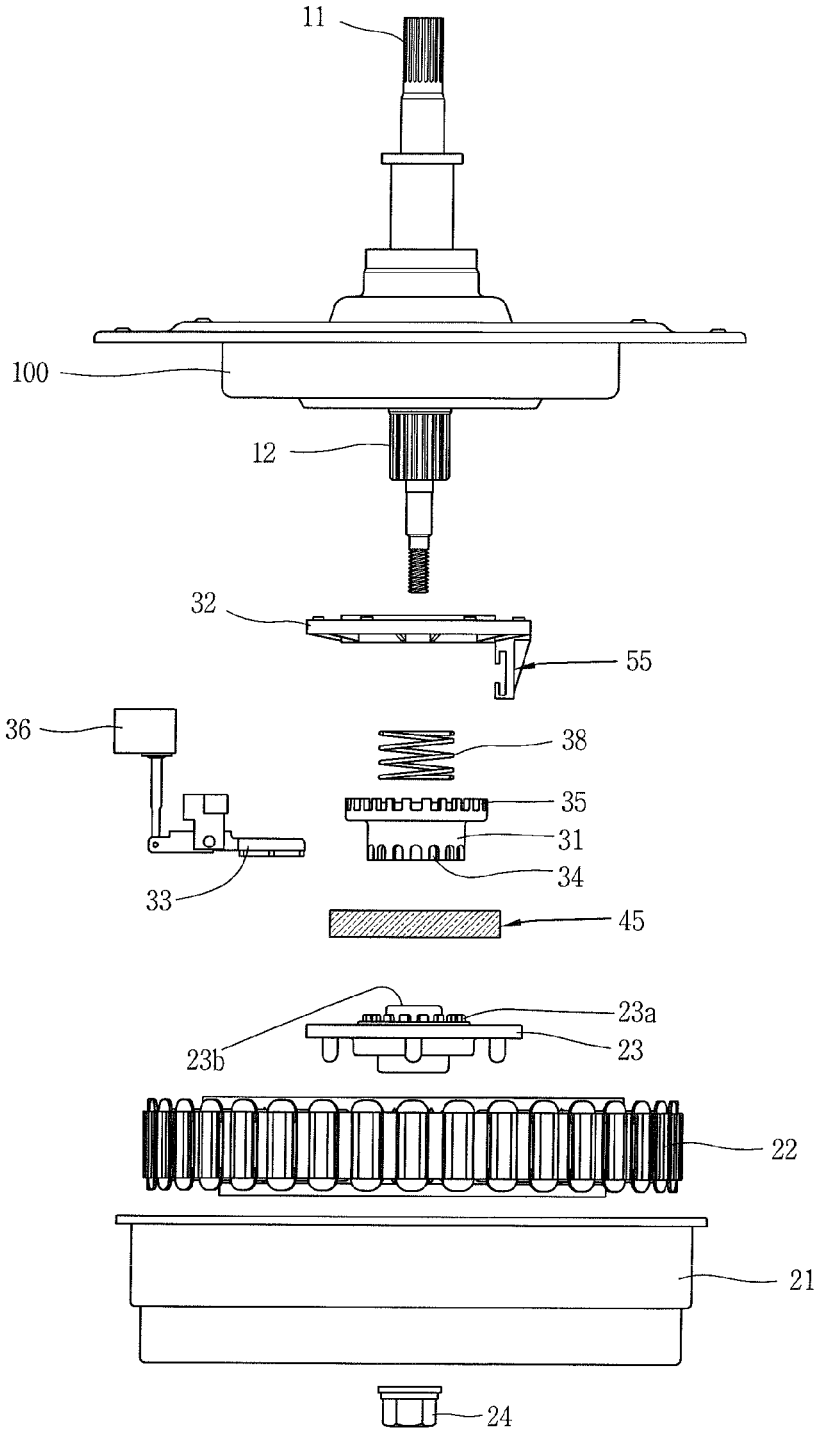
FIG. 10 is an exploded perspective view of a driving unit of a washing machine according to a fourth embodiment of the present disclosure.
Figure 11:
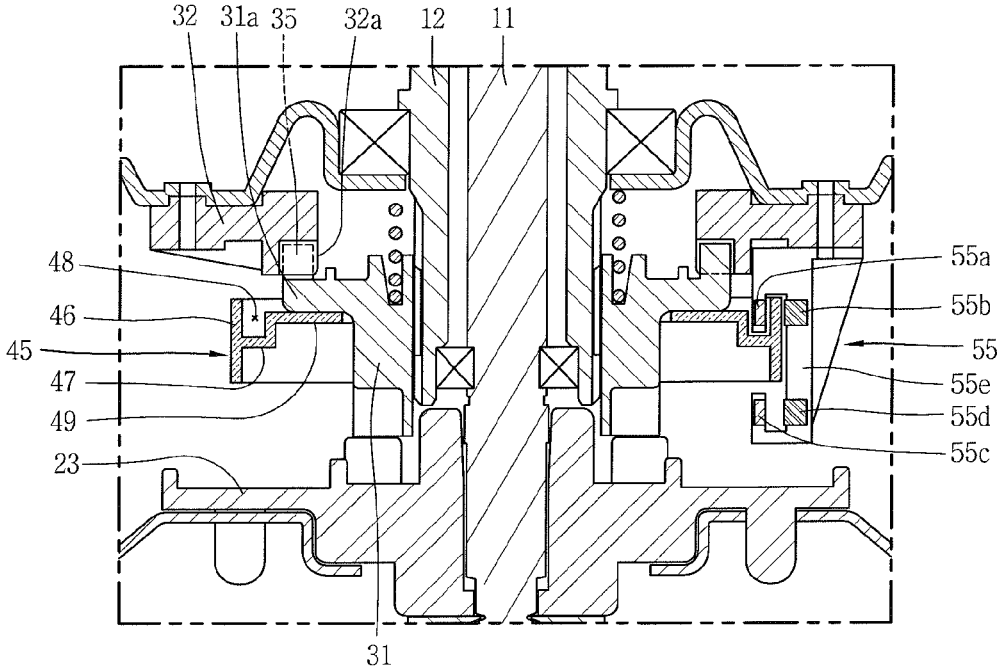
FIG. 11 is a partial sectional view showing an up position of a clutch in FIG. 10.
Figure 12:
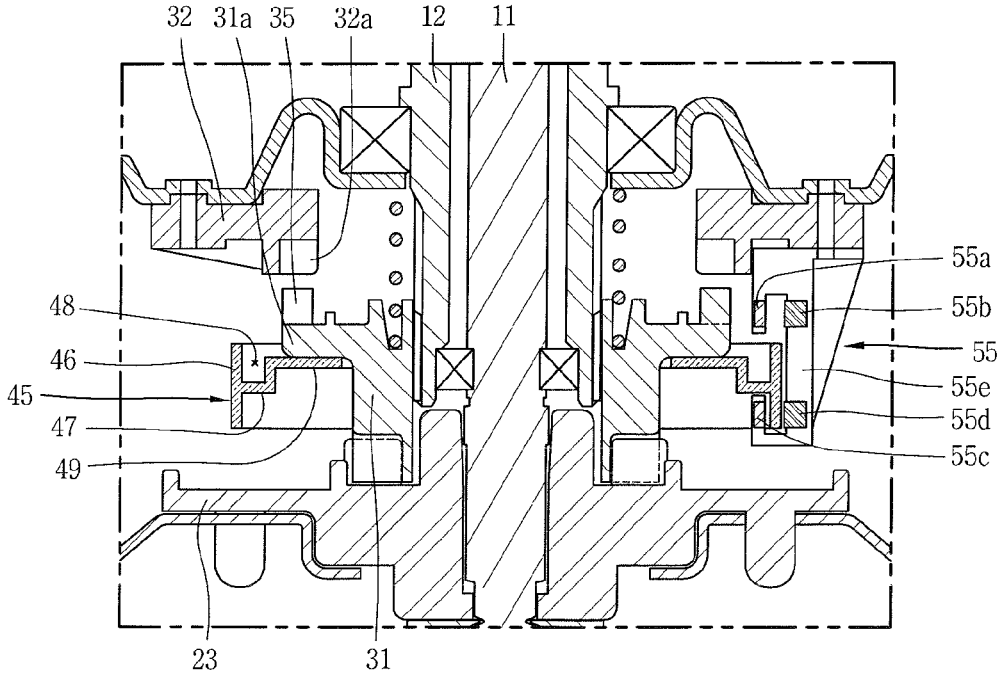
FIG. 12 is a partial sectional view showing a down position of a clutch in FIG. 10.
Figure 13:
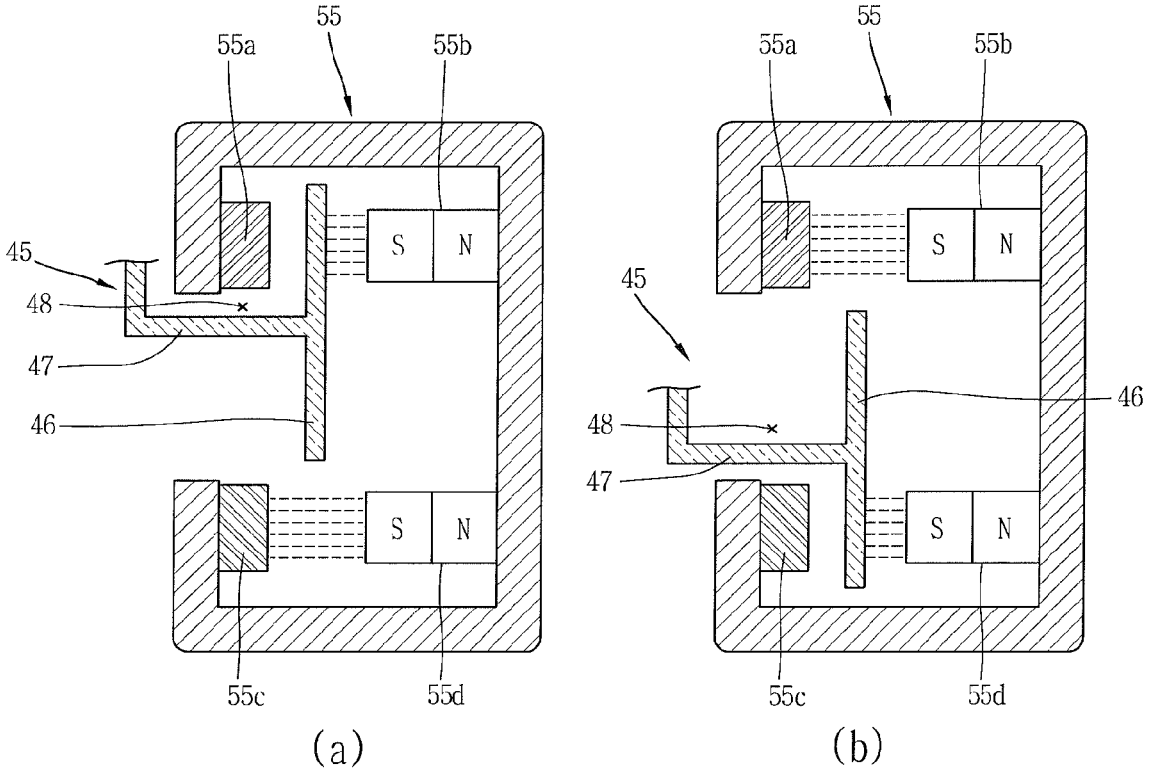
FIG. 13 is a view schematically showing a principle of a magnetism sensing apparatus according to a fourth embodiment of the present disclosure.

FIG. 10 is an exploded perspective view of a driving unit of a washing machine according to a fourth embodiment of the present disclosure, FIG. 11 is a partial sectional view showing an up position of a clutch 31 in FIG. 10, FIG. 12 is a partial sectional view showing a down position of a clutch 31 in FIG. 10, and FIG. 13 is a view schematically showing a principle of a magnetism sensing apparatus according to a fourth embodiment of the present disclosure. Explanations about the same parts as the aforementioned parts of the first embodiment will be omitted.

Referring to FIG. 10, the clutch 31 is formed in a cylindrical shape, and has teeth on upper and lower surfaces thereof. The clutch 31 is provided with a through hole at the center thereof so that a washing shaft 11 and a dehydration shaft 12 may penetrate therethrough. Teeth engaged with an outer circumferential surface of the dehydration shaft 12 for sliding thereon are formed on an inner circumferential surface of the through hole. Under this configuration, the clutch 31 is moveable to a down position for coupling with the rotor 21, and an up position for releasing a coupled state with the rotor 21 and for coupling with the clutch stopper 32.

Referring to FIGS. 11 and 12, the washing machine according to the fourth embodiment of the present disclosure comprises a shielding member 45 mounted to the clutch 31 so as to precisely sense a position of the clutch 31 according to up-down motions of the clutch 31, and a magnetism sensing apparatus 55 including a first magnetic sensor 55*a* and a first magnet 55*b* facing each other and configured to sense the clutch 31 in an up position, and including a second magnetic sensor 55*c* and a second magnet 55*d* facing each other and configured to sense the clutch 31 in a down position.

This configuration is implemented to sense whether the clutch 31 has been completely coupled with the rotor 21, or whether the clutch 31 has been completely coupled with the clutch stopper 32 by having a released state from the rotor 21. The clutch 31 may have two positions. Specifically, the clutch 31 may have a down position where the clutch 31 is coupled with the rotor 21 to transmit a rotational force to a dehydration shaft 12. And, the clutch 31 may have an up position where a coupled state between the clutch 31 and the rotor 21 is released, and the clutch 31 is coupled with the clutch stopper 32 so as to prevent undesired rotations. If the clutch 31 is not precisely disposed at the up and down positions, damages of the components, etc. may occur when a driving force is transmitted. Therefore, the two positions of the clutch 31 are precisely sensed.

As shown in FIGS. 11 and 12, the shielding member 45 is coupled with an upper part of the clutch 31. The shielding member 45 is concentrically coupled with the clutch 31 in a cylindrical shape.

Referring to FIGS. 11 and 12, the shielding member 45 has an outer circumferential surface 46, and a connection surface 47 connected to the outer circumferential surface 46 in a bending manner to form an accommodation space 48. In the accommodation space 48, accommodated are the first magnetic sensor 55*a* or the first magnet 55*b* of the magnetism sensing apparatus 55 to be later explained.

Referring to FIGS. 11 and 12, the first magnetic sensor 55*a* is accommodated in the accommodation space 48. However, the first magnetic sensor 55*a* and the first magnet 55*b* of the magnetism sensing apparatus may have their positions reversed. Accordingly, the first magnet 55*b* may be accommodated in the accommodation space 48. As the first magnetic sensor 55*a* of the first magnet 55*b* is accommodated in the accommodation space 48, an upper end of the outer circumferential surface 46 shields a space between the first magnet 55*b* and the first magnetic sensor 55*a*. Specifically, as shown in FIG. 13(*a*), an upper end of the outer circumferential surface 46 of the shielding member 45 is in an up position by a motion of the clutch 31, thereby shielding a space between the first magnet 55*b* and the first magnetic sensor 55*a*. As a result, the first magnetic sensor 55*a* senses an up position of the clutch 31.

The outer circumferential surface 46 is long extending up and down from a coupled part with the connection surface 47. An upper end of the outer circumferential surface 46 shields a space between the first magnetic sensor 55*a* and the first magnet 55*b*. In correspondence to this, a lower end of the outer circumferential surface 46 shields a space between the second magnetic sensor 55*c* and the second magnet 55*d*. That is, as shown in FIG. 13(*b*), the lower end of the outer circumferential surface 46 of the shielding member 45 is in a down position by a motion of the clutch 31, thereby shielding a space between the second magnetic sensor 55*c* and the second magnet 55*d*. As a result, the second magnetic sensor 55*c* senses a down position of the clutch 31.

The shielding member 45 further includes a coupling surface 49 inwardly extending from the connection surface for coupling with the clutch 31. The clutch 31 is provided with an extended surface 31*a* of a ring shape which outwardly extends from the center of the clutch 31, at an upper part of the clutch 31 so that upper teeth 35 may be formed. The coupling surface 49 of the shielding member 45 is coupled with a lower surface of the extended surface 31*a* in a concentric manner to the clutch 31. This allows the shielding member 45 to be always positioned on the lower surface of the extended surface 31*a* without being influenced from rotation of the clutch 31.

Preferably, the shielding member 45 is formed of a steel-based metallic material. However, the shielding member 45 may be formed of a metallic material having a magnetic property, rather than the steel-based metallic material. Once the shielding member 45 is in a position where a magnetic field is formed, the shielding member 45 can perform a shielding function since lines of induction are concentrated (i.e., drawn) thereto.

The shielding member 45 is configured to alternately shield a space between the first magnet 55*b* and the first magnetic sensor 55*a*, and a space between the second magnet 55*d* and the second magnetic sensor 55*c* according to up-down motions of the clutch 31, and the magnetism sensing apparatus 55 is configured to sense a position of the clutch 31 by the alternating shielding of the shielding member 45.

Referring to FIGS. 11 and 12, the magnetism sensing apparatus 55 is positioned on a side surfaced of the clutch 31. With reference to FIG. 10, a clutch stopper 32 configured to prevent motions of the clutch 31 which has moved upward is provided above the clutch 31. The clutch stopper 32 is fixed to a bearing housing 100. The magnetism sensing apparatus 55 is coupled with a holding plate fixed to the clutch stopper 32. As shown in FIGS. 11 and 12, the magnetism sensing apparatus 55 is coupled with the clutch stopper so as to be fixed to a side surface of the clutch 31.

The magnetism sensing apparatus 55 has a first magnetic sensor 55*a* and a first magnet 55*b* facing each other and configured to sense the clutch 31 in an up position, and having a second magnetic sensor 55*c* and a second magnet 55*d* facing each other and configured to sense the clutch 31 in a down position.

Referring to FIG. 13, the first magnet 55*b* is configured to face the first magnetic sensor 55*a* with a predetermined distance therebetween, and the second magnet 55*d* is configured to face the second magnetic sensor 55*c* with a predetermined distance therebetween. In this configuration, the shielding member 45 alternately shields a space between the first magnet 55*b* and the first magnetic sensor 55*a*, and a space between the second magnet 55*d* and the second magnetic sensor 55*c* by entering the spaces.

As aforementioned, the first magnet 55*b* and the first magnetic sensor 55*a* may have their positions reversed, and the second magnet 55*d* and the second magnetic sensor 55*c* may have their positions reversed. That is, in FIGS. 3 to 5, the positions of the first magnet, the first magnetic sensor, the second magnet and the second magnetic sensor are fixed. However, in this embodiment the first magnet 55*b*, the first magnetic sensor 55*a*, the second magnet 55*d*, and the second magnetic sensor 55*c* may have variable positions so long as they can sense a position of the clutch 31 by sensing introduction of the shielding member 45.

Generally, if a metallic member having a magnetic property is positioned near a magnet, a magnetic field of the magnet is concentrated (i.e., drawn) to the metallic member. Therefore, if an outer circumferential surface of the shielding member 45 is in a space between the first magnet 55*b* and the first magnetic sensor 55*a*, and a space between the second magnet 55*d* and the second magnetic sensor 55*c*, a magnetic field does not trigger the magnetic sensors 55*a*/55*c* since lines of induction of the magnets are concentrated to the shielding member 45. Thus, the magnetic sensors 55*a*/55*c* sense a position of the clutch 31 by a magnetic field which has disappeared therefrom.

As shown in FIG. 13(*a*), when the clutch is in an up position, the first magnetic sensor 55*a* or the first magnet 55*b* of the magnetism sensing apparatus 55 is accommodated in the accommodation space 48. As a result, an upper end of an outer circumferential surface of the shielding member 45 shields a space between the first magnet 55*b* and the first magnetic sensor 55*a*. In an up position, the clutch 31 is engaged with the clutch stopper 32. Referring to FIG. 11, when the clutch 31 is in an up position, the upper teeth 35 of the clutch 31 are engaged with the teeth 32*a* of the clutch stopper 32. This may allow the first magnetic sensor 55*a* of the magnetism sensing apparatus 55 to precisely sense an up position of the clutch 31.

As shown in FIG. 13(*b*), when the clutch 31 is in a down position, a lower end of the outer circumferential surface 46 of the shielding member 45 shields a space between the second magnet 55*d* and the second magnetic sensor 55*c*. When the clutch 31 is in a down position, the clutch 31 is engaged with the shaft coupling portion 23 of the rotor 21. Referring to FIG. 12, when the clutch 31 is in a down position, the lower teeth 34 of the clutch 31 are engaged with the teeth 23*a* of the shaft coupling portion 23 of the rotor 21. This allows the second magnetic sensor 55*c* of the magnetism sensing apparatus 55 to precisely sense a down position of the clutch 31.

In the present disclosure, an up position and/or a down position of the clutch 31 may be precisely sensed to precisely sense a coupled state between the clutch 31 and the rotor 21, or between the clutch 31 and the clutch stopper 32. This may prevent damage and/or operational failure of the washing machine's components, thereby enhancing the reliability of the washing machine.

As shown in FIGS. 10 to 13, the first magnet 55*b*, the first magnetic sensor 55*a*, the second magnet 55*d*, and the second magnetic sensor 55*c* may be integrally formed with each other. That is, the first magnet 55*b*, the first magnetic sensor 55*a*, the second magnet 55*d*, and the second magnetic sensor 55*c* are coupled with one holding plate to constitute the magnetism sensing apparatus 55. This simplifies the entire structure.

In the fifth embodiment, it is sensed whether the clutch 31 and the rotor 21 of the first to third embodiments have been completely coupled with each other. In the fifth embodiment, an electronic device is not installed at the rotor 21, etc.

Figure 14:
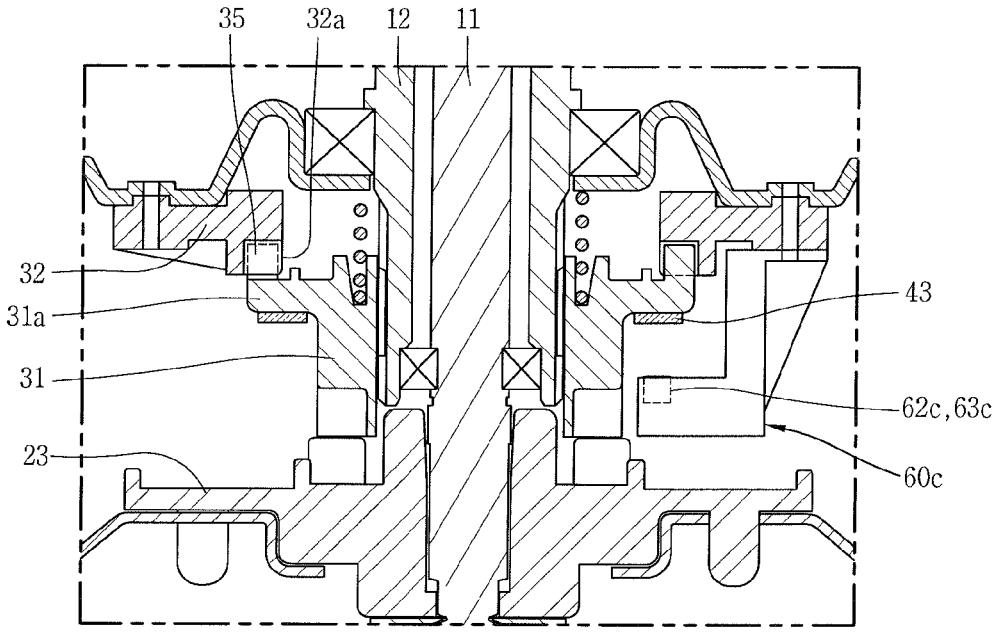
FIG. 14 is a partial sectional view showing a washing machine according to a fifth embodiment of the present disclosure.
Figure 15:
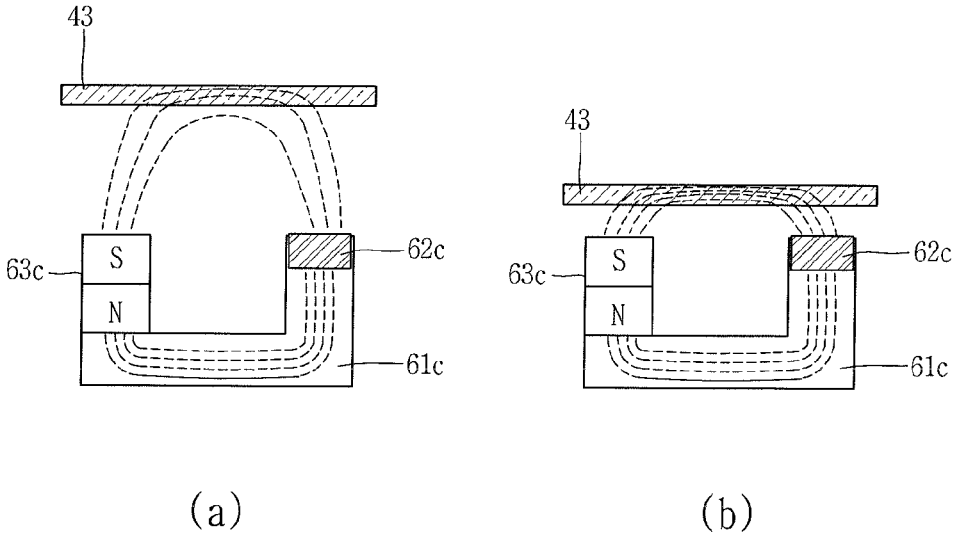
FIG. 15 is a schematic view showing a principle of the fifth embodiment.

Referring to FIGS. 14 and 15, the washing machine according to the fifth embodiment comprises a ring-shaped metallic plate 43 mounted to a clutch 31, and a magnetism sensing apparatus 60*c* including a metallic connection member 61*c* having two ends bent in the same direction, and including a magnet 63*c* and a magnetic sensor 62*c*, each attached to opposite ends of the two ends of the metallic connection member 61*c* with a predetermined distance therebetween.

As shown in FIG. 14, the ring-shaped metallic plate 43 is coupled with an upper part of the clutch 31. An extended surface 31*a* of a ring shape which outwardly extends from the center of the clutch 31 is provided at an upper part of the clutch 31 so that upper teeth 35 may be formed. The ring-shaped metallic plate 43 is coupled with a lower surface of the extended surface 31*a* in a concentric manner to the clutch 31. This allows the ring-shaped metallic plate 43 to be always positioned on the lower surface of the extended surface without being influenced from rotation of the clutch 31.

Referring to FIG. 15, the magnetism sensing apparatus 60*c* includes the metallic connection member 61*c*, the magnetic sensor 62*c*, and the magnet 63*c*, and is fixedly-supported at a holding plate coupled to a clutch stopper 32 or a bearing housing 100. The metallic connection member 61*c* is formed in a '⊂' shape or a '¬' shape, and is provided with the magnetic sensor 62*c* and the magnet 63*c* at two opposite ends thereof as shown in FIG. 15. The two ends of the metallic connection member 61*c* are bent in the same direction. That is, the magnetic sensor 62*c* and the magnet 63*c* are disposed in parallel toward the upper side.

In this case, a magnetic field is generated from one pole of the magnet 63*c* along the metallic connection member 61*c*, and a magnetic field is generated from to another pole of the magnet 63*c* in an arc shape toward the magnetic sensor 62*c*. That is, a magnetic field is formed as indicated by the dotted lines of FIG. 15.

The magnetism sensing apparatus 60*c* is disposed below the metallic plate 43 so as to sense a down position of the clutch 31 when the clutch 31 and the rotor 21 are coupled with each other. If the clutch 31 is moved to a down position for coupling with the rotor 21, the metallic plate 43 approaches to the magnetism sensing apparatus 60*c*.

If a gap between a magnetic substance such as a magnet and a metallic member is decreased as the metallic member approaches to the magnetic substance, a magnetism therebetween is increased. Once the metallic plate 43 moves downward to approach the magnet 63*c* and the magnetic sensor 62*c*, a magnetism between the two ends of the metallic connection member 61*c* is increased. The magnetic sensor 62*c* senses an increased degree of the magnetism to sense a position of the clutch 31.

In the above configuration, a strength of a magnetism sensed by the magnetic sensor 62*c* is increased by using the ring-shaped metallic plate 43 which can increase a magnetism. Accordingly, the magnetic sensor 62*c* may sense approaching of the clutch 31 more precisely than in a case where a position of the clutch 31 is sensed based on a distance between the magnetic sensor 62*c* and the magnet 63*c*. This allows whether the clutch 31 has been coupled with the rotor 21 or not to be precisely sensed, and thus may prevent damage and/or operational failure of the driving unit of the washing machine. Furthermore, an electric device for sensing is not installed at the rotor 21 and the shaft coupling portion 23. This may enhance the reliability of the washing machine.

In the sixth embodiment, it is sensed whether a coupled state between the clutch 31 and the rotor 21 of the first to third embodiments has been completely released. That is, it is sensed whether the clutch 31 is prevented from moving by being completely coupled with the clutch stopper 32. The clutch may have two positions. Specifically, the clutch 31 may have a down position where the clutch 31 is coupled with the rotor 21 to transmit a rotational force to a dehydration shaft 12. And, the clutch 31 may have an up position where a coupled state between the clutch 31 and the rotor 21 is released, and the clutch 31 is coupled with the clutch stopper 32 so as to prevent undesired rotations. If the clutch 31 is not precisely disposed at the up and/or down positions, damages of the components may occur when a driving force is transmitted. In this embodiment, an up position of the two positions of the clutch 31 is sensed.

Figure 16:
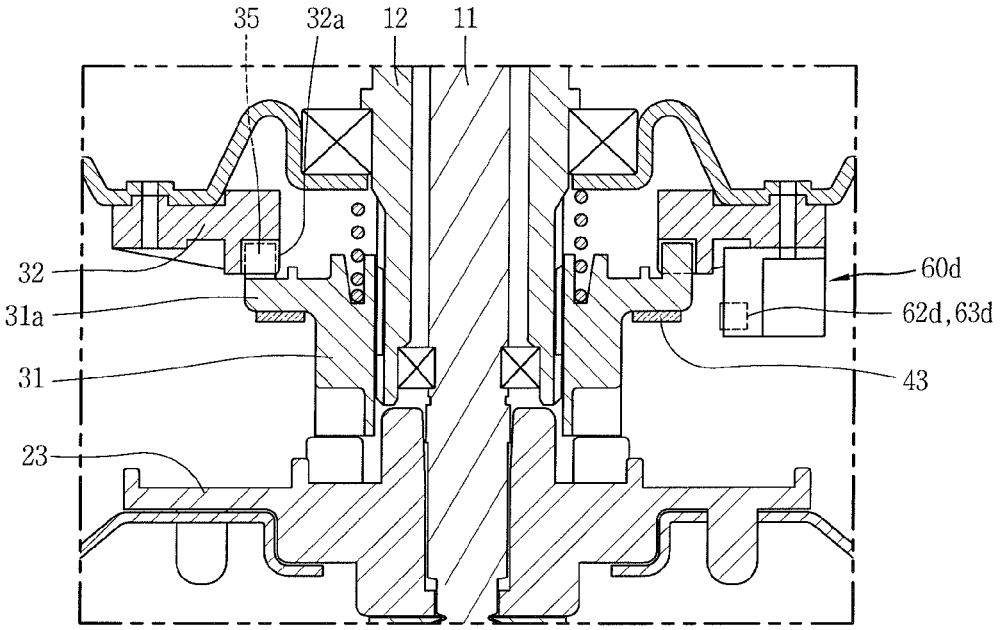
FIGS. 16 and 17 are partial sectional views showing a washing machine according to a sixth embodiment of the present disclosure.
Figure 17:
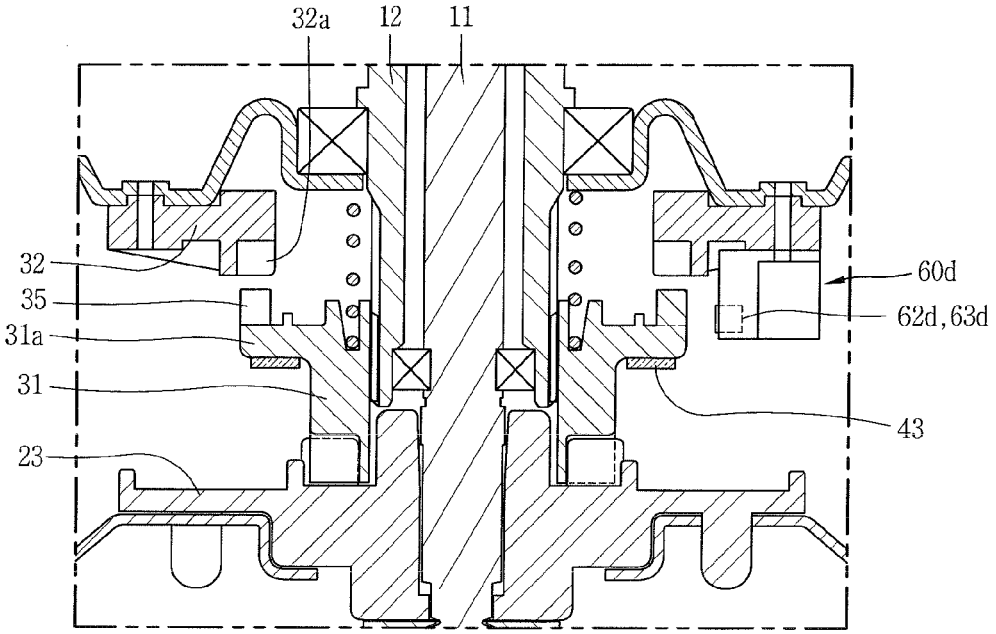
Figure 18:
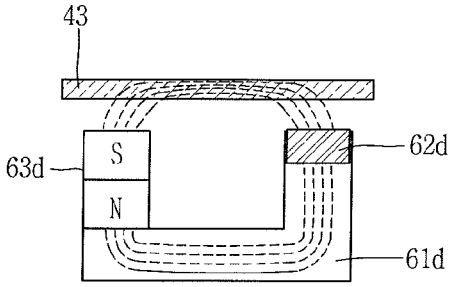
FIG. 18 is a schematic view showing a principle of the sixth embodiment.

FIGS. 16 to 18 are sectional views showing a washing machine according to the sixth embodiment. Referring to FIGS. 16 to 18, the washing machine according to the sixth embodiment comprises a ring-shaped metallic plate 43 mounted to a clutch 31, and a magnetism sensing apparatus 60*d* including a metallic connection member 61*d* having two ends bent in the same direction, and including a magnet 63*d* and a magnetic sensor 62*d* attached to opposite ends of the two ends of the metallic connection member 61*d* with a predetermined distance therebetween.

As shown in FIG. 16, the ring-shaped metallic plate 43 is coupled to an upper part of the clutch 31. An extended surface 31*a* of a ring shape which outwardly extends from the center of the clutch 31 is provided at an upper part of the clutch 31 so that upper teeth 35 may be formed. The ring-shaped metallic plate 43 is coupled with a lower surface of the extended surface 31*a* in a concentric manner to the clutch 31. This allows the ring-shaped metallic plate to be always positioned on the lower surface of the extended surface without being influenced from rotation of the clutch 31.

Referring to FIG. 18, the magnetism sensing apparatus 60*d* includes the metallic connection member 61*d*, the magnetic sensor 62*d* and the magnet 63*d*. The metallic connection member 61*d* is formed in a '⊏' shape or a '¬' shape, and is provided with the magnetic sensor 62*d* and the magnet 63*d* at two ends thereof.

The two ends of the metallic connection member 61*d* are bent in the same direction. That is, the magnetic sensor 62*d* and the magnet 63*d* are disposed in parallel toward the same direction, a side surface of the clutch 31.

The magnetism sensing apparatus 60*d* is disposed on a side surface of the metallic plate 43 so as to sense an up position of the clutch 31 where a coupled state between the clutch 31 and the rotor 21 is released. A clutch stopper 32 configured to prevent motions of the clutch 31 which has upward moved is coupled with a bearing housing 100 above the clutch 31.

In order to smoothly rotate a washing shaft 11 by having a released state from the rotor 21, the clutch 31 has to be engaged with the clutch stopper 32 so as to be prevented from moving. That is, the magnetism sensing apparatus 60*d* is fixedly-coupled with a side surface of the clutch stopper 32, and senses a coupled state between the clutch 31 and the clutch stopper 32 in a facing manner to a side surface of the clutch 31.

FIG. 16 shows an up position of the clutch 31. Referring to FIG. 16, the clutch 31 is disposed to face the magnetism sensing apparatus 60*d*. If the metallic plate 43 upward moves to approach to the magnet 63*d* and the magnetic sensor 62*d*, a magnetism between two ends of the connection member 61*d* is increased as shown in FIG. 18. The magnetic sensor 62*d* senses an increased degree of the magnetism to sense a position of the clutch 31. If the clutch 31 is in an up position, the upper teeth 35 of the clutch 31 and the teeth 32*a* of the clutch stopper 32 are engaged with each other to prevent motions of the clutch 31.

FIG. 17 shows a down position of the clutch 31. Referring to FIG. 17, if the clutch 31 downward moves so as to be coupled with the rotor 21, the metallic plate 43 is spaced from the magnetism sensing apparatus 60*d*. As a result, the magnetic sensor 62*d* senses a decreased magnetism, thereby sensing a coupled state between the clutch 31 and the rotor 21.

In the above configuration, a strength of a magnetism sensed by the magnetic sensor 62*d* is increased by using the ring-shaped metallic plate 43 which can increase a magnetism. Accordingly, the magnetic sensor 62*d* may sense approaching of the clutch 31 more precisely than in a case where a position of the clutch is sensed based on a distance between the magnetic sensor 62*d* and the magnet 63*d*. This allows whether the clutch 31 has been coupled with the rotor 21 or not to be precisely sensed, and thus may prevent damage and/or operational failure of the driving unit of the washing machine. Furthermore, an electric device for sensing is not installed at the rotor 21 and the shaft coupling portion 23. This may enhance the reliability of the washing machine.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A washing machine, comprising:

a washing shaft;

a dehydration shaft;

a rotor, coupled to the washing shaft, to transmit a rotational force to the washing shaft;

a clutch to selectively couple with the rotor, wherein said coupling is to transmit the rotational force of the rotor to the dehydration shaft;

a shielding member mounted to the clutch; and a magnetism sensing apparatus including a metallic connection member having two ends bent in the same direction, and including a magnet and a magnetic sensor attached to opposite ends of the two ends of the metallic connection member with a predetermined distance therebetween, wherein the shielding member is configured to shield a space between the magnet and the magnetic sensor, and wherein the magnetic sensor senses a position of the clutch by sensing a magnetism increase between the two ends of the metallic connection member as the shielding member approaches to the magnetism sensing apparatus by a motion of the clutch.

2. The washing machine of claim 1, wherein the magnetism sensing apparatus is disposed below the clutch so as to sense a down position of the clutch where the clutch and the rotor are coupled with each other.

3. The washing machine of claim 1, wherein the magnetism sensing apparatus is disposed above the clutch so as to sense an up position of the clutch where the clutch and the rotor are released from each other.

4. The washing machine of claim 3, further comprising:

a clutch stopper, disposed above the clutch, to prevent motions of the clutch which has moved upward, wherein the magnetism sensing apparatus is coupled with a side surface of the clutch stopper, and senses a coupled state between the clutch and the clutch stopper.

5. The washing machine of claim 1, wherein the clutch comprises two states, a released state when the clutch is in an up position, and a coupled state when the clutch is in a down position, wherein the magnetism sensing apparatus has a first magnetic sensor and a first magnet facing each other and configured to sense the clutch in the up position, and has a second magnetic sensor and a second magnet facing each other and configured to sense the clutch in the down position, wherein the shielding member alternately shields a space between the first magnet and the first magnetic sensor, and a space between the second magnet and the second magnetic sensor according to the position of the clutch, and wherein the magnetism sensing apparatus senses a position of the clutch.

6. The washing machine of claim 5, wherein the shielding member is concentrically coupled with the clutch in a cylindrical shape.

7. The washing machine of claim 6, wherein the first magnet and the first magnetic sensor are disposed to face each other with a gap therebetween, and the second magnet and the second magnetic sensor are disposed to face each other with a gap therebetween, and wherein the shielding member alternately shields a space between the first magnet and the first magnetic sensor, and a space between the second magnet and the second magnetic sensor, by alternately entering the spaces.

8. The washing machine of claim 7, wherein the shielding member includes an outer circumferential surface, and a connection surface connected to the outer circumferential surface and forming an accommodation space, wherein as the first magnetic sensor or the first magnet of the magnetism sensing apparatus is accommodated in the accommodation space when the clutch is in the up position, the outer circumferential surface of the shielding member shields a space between the first magnet and the first magnetic sensor.

9. The washing machine of claim 5, wherein the first magnet, the first magnetic sensor, the second magnet, and the second magnetic sensor are integrally coupled with one another.

10. The washing machine of claim 5, further comprising:

a clutch stopper, disposed above the clutch, to prevent motions of the clutch when the clutch has moved upward, wherein the magnetism sensing apparatus senses a coupled state between the clutch and the clutch stopper when the clutch is in an up position, and senses a coupled state between the clutch and the rotor when the clutch is in a down position.

11. The washing machine of one of claim 1, wherein the shielding member is formed of a steel-based metallic material.

* * * * *